US006349935B1

(12) United States Patent
Boguhn et al.

(10) Patent No.: US 6,349,935 B1
(45) Date of Patent: Feb. 26, 2002

(54) DEVICE FOR FEEDING SHEETS TO A SHEET-PROCESSING MACHINE

(75) Inventors: Hans Peter Boguhn, Heidelberg; Gaby Fasler, Bruchsal, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/356,403

(22) Filed: Jul. 16, 1999

(51) Int. Cl.[7] ..... B65H 7/02; B65H 5/12

(52) U.S. Cl. ..... 271/265.01; 271/268; 271/85; 101/408

(58) Field of Search ..... 271/267, 268, 271/85, 265.01; 101/232, 246, 408, 409

(56) References Cited

U.S. PATENT DOCUMENTS 3,190,645 A 6/1965 Reinartz
4,132,403 A * 1/1979 Weisbach et al. ..... 101/246
4,290,595 A * 9/1981 Thunker ..... 101/246
4,295,422 A 10/1981 Thünker
4,370,928 A * 2/1983 Weisbach ..... 271/268
5,076,165 A * 12/1991 Pollich ..... 101/409
5,168,809 A * 12/1992 Becker ..... 101/408
5,440,983 A * 8/1995 Dopke et al. ..... 271/268
6,000,694 A * 12/1999 Kruger ..... 271/268

FOREIGN PATENT DOCUMENTS

DE 43 32 683 A1 3/1995

* cited by examiner

*Primary Examiner*—H. Grant Skaggs
(74) *Attorney, Agent, or Firm*—Herbert L. Lerner; Laurence A. Greenberg; Werner H. Stemer

(57) ABSTRACT

A device for driving a pregripper having a swivellably mounted main lever and a swivellably mounted guide lever, and a gripper bar mutually coupling the main lever and the guide lever, includes a cyclical swivel drive for the main lever, and an eccentrically swivellable bearing location for the guide lever.

22 Claims, 4 Drawing Sheets

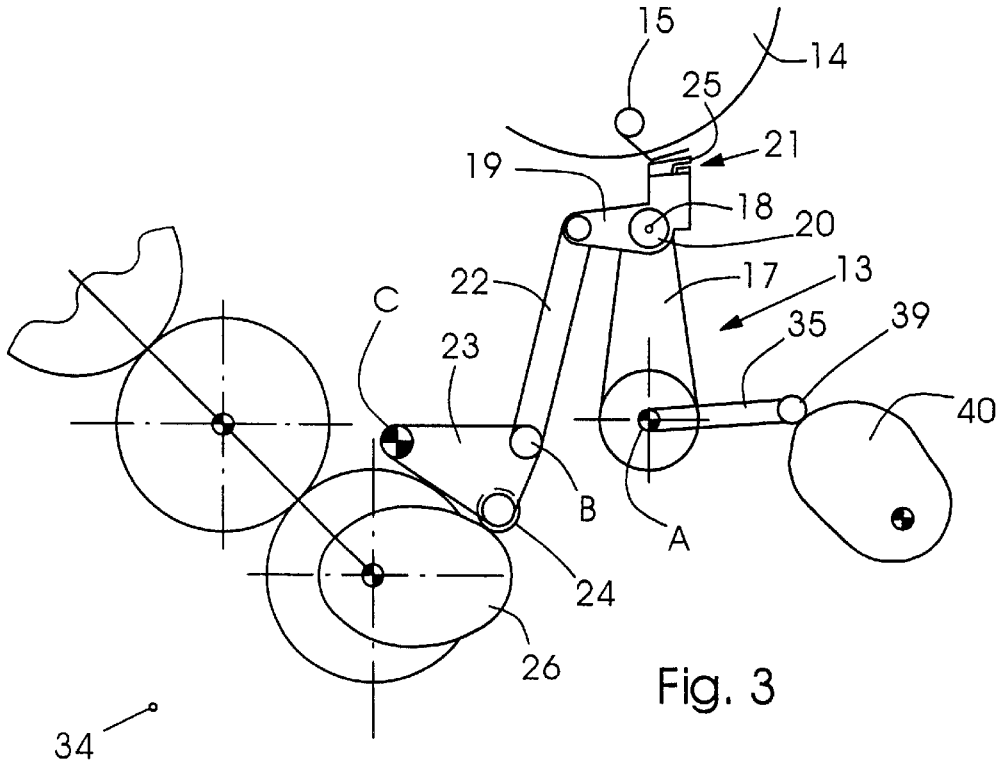
Fig. 3
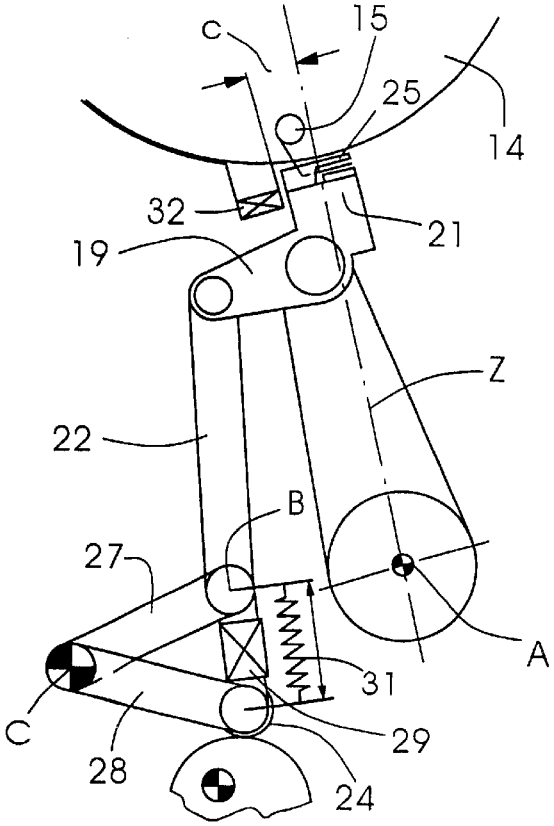
Fig. 4
Fig. 5
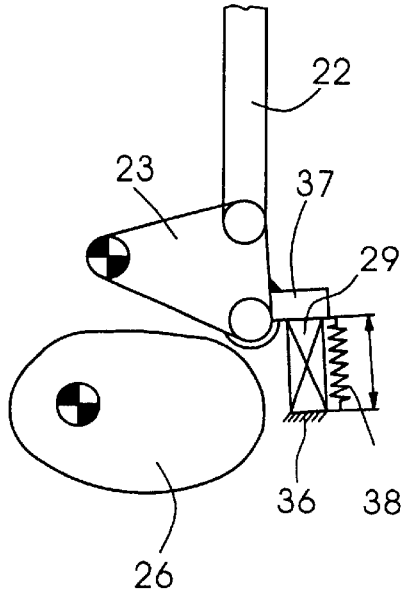

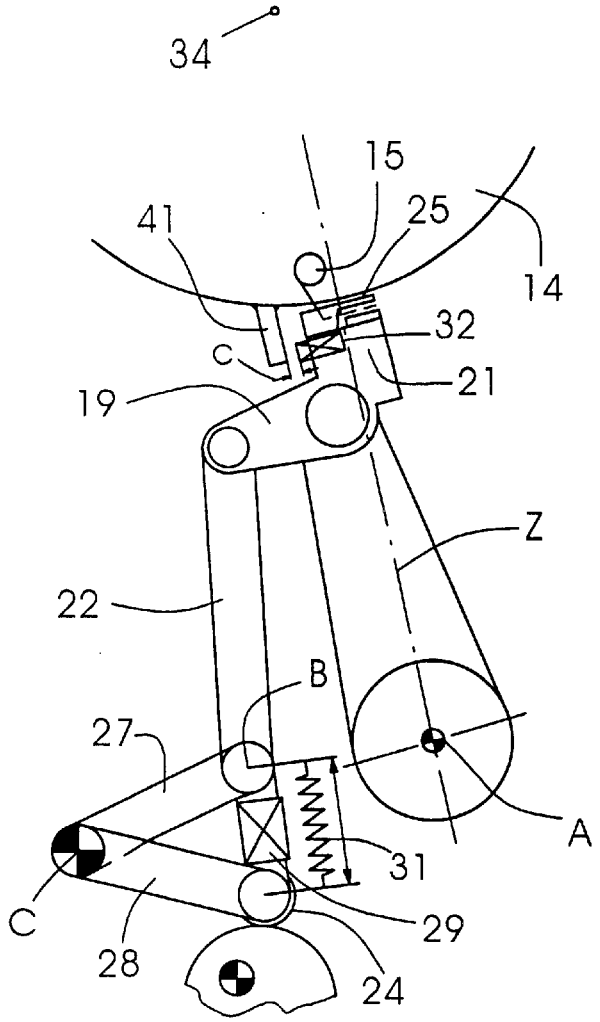
Fig.6
Fig.7
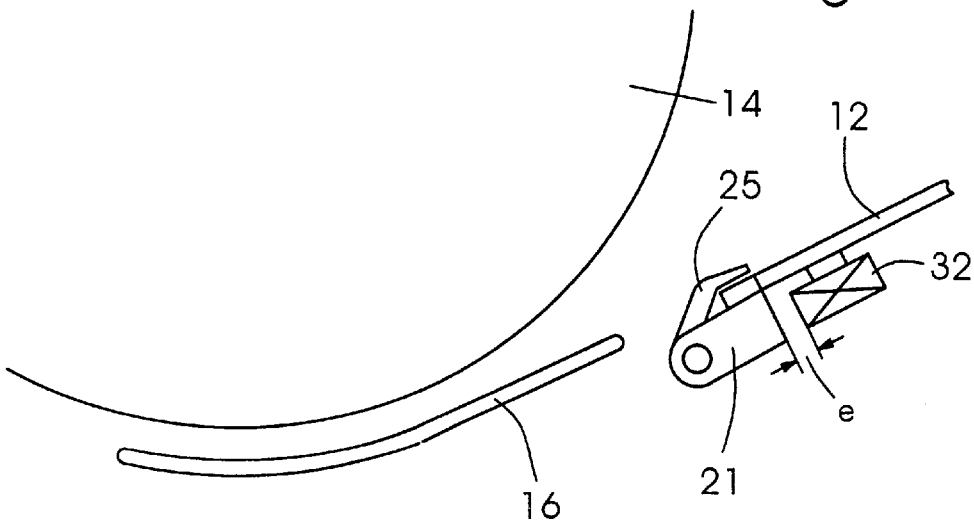

DEVICE FOR FEEDING SHEETS TO A SHEET-PROCESSING MACHINE

Background of the Invention

Field of the Invention

The invention relates to a device for feeding sheets to a sheet-processing machine, in particular to a printing machine having a reciprocating pregripper that receives the sheets from a feeding table and transfers them to a feed drum of the sheet-fed rotary printing machine.

The problem with such sheet transportation, in particular in the case of sheets which have already been printed at least once beforehand, is that these sheets may be scratched or smudged by contact with the provided transporting and aligning equipment. Furthermore, at high operating speeds, the sheets tend to form so-called infeed buckling (caused by a change in curvature of the transporting path), in the case of which the end of the sheet rises up on the feed drum and, upon detachment from the feed drum, causes a by no means inconsiderable level of noise, and possible damage to the sheet.

The published German Patent Document DE 43 22 416 A1 discloses a feeding table of which an imaginary extension intersects the periphery of a feed drum. A pregripper disposed so as to be swingable beneath the conveying plane transports the sheet on a circular sheet-movement path about a swivel point of the swing axis of the pregripper.

As it is swivelled back to the feeding table, the pregripper passes through the conveying plane of the sheet. In order to avoid contact between the pregripper and the sheet, however, swivellably arranged directing elements are provided for lifting the sheet so high that the sheet does not come into contact with the pregripper. Uniform sheet guidance is thereby disrupted.

A further disadvantage with respect to the aforementioned published German Patent Document DE 43 22 416 A1 is that an infeed gap between the sheet-directing element and the feed cylinder becomes smaller due to the lifting of the sheet-directing element. Furthermore, the sheet that is to be transported is curved additionally in the sheet-movement path.

SUMMARY OF THE INVENTION

It is accordingly an object of the invention to provide a device for feeding sheets to a sheet-processing machine with which a uniform sheet-movement path is produced.

With the foregoing and other objects in view, there is provided, in accordance with the invention, a device for driving a pregripper having a swivellably mounted main lever and a swivellably mounted guide lever, and a gripper bar mutually coupling the main lever and the guide lever, comprising a cyclical swivel drive for the main lever, and an eccentrically swivellable bearing location for the guide lever.

In accordance with another feature of the invention, the driving device includes a feed table, and an imaginary extension of the feed table spaced a given distance from a periphery of a feed drum.

In accordance with a further feature of the invention, during a transporting movement of a sheet from the feed table to gripper devices of the feed drum, a movement path is describable by the pregripper differing from that of a return movement thereof back to the feed table from a turning position of the pregripper.

In accordance with an added feature of the invention, during the transporting movement of the sheet from the feed table to the gripper devices of the feed drum, the sheet is movable by the pregripper into an infeed gap defined by an imaginary extension of the feed table and a periphery of the feed drum, the pregripper, during the return movement thereof, being movable back beneath the imaginary extension of the feed table.

In accordance with an additional feature of the invention, the pregripper has a first cam gear mechanism for swivellingly moving the main lever, and a second cam gear mechanism for swivellingly moving the gripper bar.

In accordance with yet another feature of the invention, the first cam gear mechanism is connected to a couple by the main lever, and the second cam gear mechanism is connected to the couple by the guide lever.

In accordance with yet a further feature of the invention, an articulated point of the main lever on the couple is a gripper shaft of a gripper of the pregripper.

In accordance with yet an added feature of the invention, the driving device includes fixedly disposed directing brackets.

In accordance with yet an additional feature of the invention, the directing brackets are spaced apart a given distance from the feed drum of the feed table.

In accordance with still another feature of the invention, the given distance between the directing brackets and the feed drum is at most equal to a distance between an imaginary extension of the feed table and the feed drum.

In accordance with still a further feature of the invention, the driving device includes a sensor and an actuator for correcting incorrect movements of the pregripper.

In accordance with still an added feature of the invention, the driving device includes a roller lever for deflecting the guide lever, the roller lever having a variable length between the cam roller and the swivellable bearing location of the guide lever.

In accordance with still an additional feature of the invention, the roller lever is formed of two swivellable levers having a common swivel point.

In accordance with another feature of the invention, the swivellable levers are mutually coupled by an actuator.

In accordance with a further feature of the invention, one of the swivellable levers is articulated on the guide lever, and the other of the swivellable levers bears the cam roller.

In accordance with an added feature of the invention, the driving device includes a sensor for determining incorrect movements of the pregripper, and a signalling device for emitting correction signals to an actuator.

In accordance with an additional feature of the invention, the driving device includes an actuator disposed between a framework-fixed bearing point and a stop of the roller lever.

In accordance with yet another feature of the invention, the actuator is capable of receiving correction signals as a function of incorrect movements of the pregripper which have been determined by a sensor.

In accordance with yet a further feature of the invention, the sensor is disposed on a feed drum.

In accordance with yet an added feature of the invention, the sensor is disposed on a structural feature selected from the group consisting of a feed drum, a feed table and the pregripper.

In accordance with a concomitant feature of the invention, the sensor is disposed in a stationary manner.

An advantage of the invention is that, on the swivelling path from the feed cylinder to the feed table, the pregripper describes a different movement path, which is located beneath the sheet-feeder. A result thereof is that the following sheet does not come into contact with the gripper that is swivelling or pivoting back, and thus is also not scratched.

A further advantage of the invention is that the imaginary extension of the feed table is at a distance from the feed drum. This measure prevents the situation wherein the sheet drawn off from the feed table by the gripper device, which is provided on the feed cylinder, forms so-called infeed buckling. Furthermore, the infeed path is curved to a lesser extent, with the result that, as the sheet is fed in, the sheet deforms to a lesser extent and is thus also fed with fewer markings thereon.

In a favorable configuration of the invention, a cam gear mechanism and an eccentric gear mechanism, which are coupled to one another, are provided for the purpose of achieving the movement geometry according to the invention. Stationary directing brackets which are provided define clear separation of the movement paths. The pregripper advantageously comprises a main lever that pivots or swivels about a framework-fixed pivot or swivel point, and a guide lever that swivels or pivots about an eccentrically swivellable or pivotable swivel or pivot point. A couple that bears the gripper bar connects the guide lever and the main lever.

In order to conserve or economize on moved masses, the gripper shaft may be arranged coaxially with the bearing location of the main lever and the couple.

A further advantage is to provide sensors and actuators which monitor and correct incorrect movements of the pregripper. This measure ensures higher-quality sheet transportation.

A further development, for the purpose of correcting incorrect movements, makes provision for arranging an actuator in a roller lever that is connected in an articulated manner to the guide lever. This allows the couple or coupling link, or the gripper bar to be pivoted or swivelled relative to the main lever, with the result that it is possible to correct the position of the sheet in the circumferential direction during transportation by way of the pregripper.

In the case of another exemplary embodiment, the actuator is mounted on the framework and, in the event of correction, displaces a stop for the roller lever so that the cam roller lifts off from the cam. A sensor senses or determines actual-value deviations in the transfer path of the pregripper from the feed table up to the transfer to the feed drum, and provides the actuators with the determined correction data.

In this regard, it is also possible for the sensor to be arranged in a stationary manner on the feed table, with the result that a distance between the pregripper and the feed table can be sensed or determined and corrected by the actuator. Supply lines to the stationary sensor may likewise advantageously be laid in a stationary manner, with the result that the service life of each of the supply lines is improved.

Other features which are considered as characteristic for the invention are set forth in the appended claims.

Although the invention is illustrated and described herein as embodied in a device for feeding sheets to a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 3 is an enlarged fragmentary side elevational view of FIG. 1 showing an embodiment of the pregripper drive according to the invention;

FIG. 4 is an enlarged fragmentary diagrammatic view of FIG. 3 showing another embodiment of the pregripper drive;

FIG. 5 is an enlarged fragmentary diagrammatic view of FIG. 3 showing a further embodiment of the pregripper drive;

FIG. 6 is an enlarged fragmentary diagrammatic view of FIG. 3 showing an added embodiment of the pregripper drive; and FIG. 7 is an enlarged fragmentary diagrammatic view of FIG. 3 showing an additional embodiment of the pregripper drive.

DESCRIPTION OF THE PREFERRED EMBODIMENTS

Figure 1:
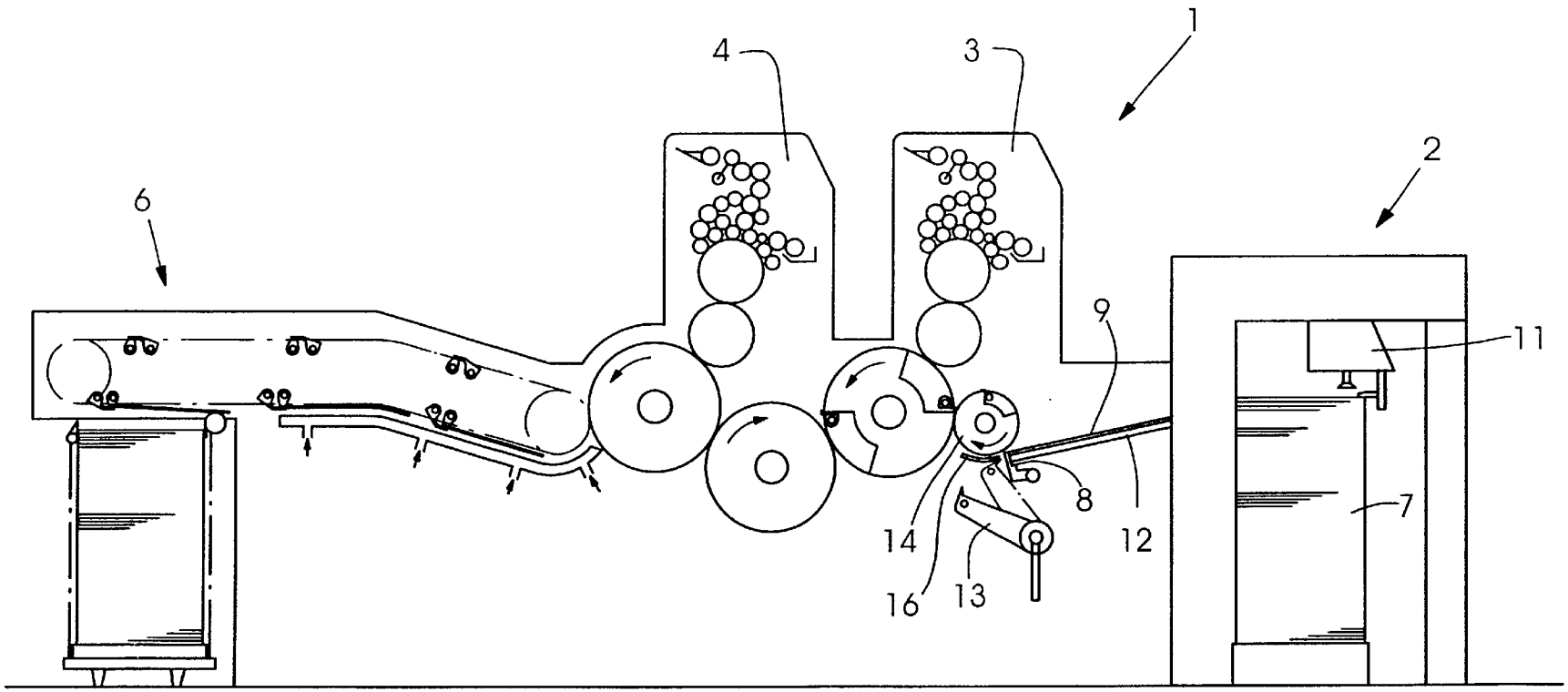
FIG. 1 is a diagrammatic side elevational view of a sheet-processing machine incorporating the feeding device according to the invention.

Referring now to the drawings and, first, particularly to FIG. 1 thereof, there is shown therein a sheet-fed rotary printing machine 1 having a feeder 2, at least one if not more printing units 3, 4, namely, two printing units 3 and 4 in the illustrated embodiment, and a delivery 6. Sheets 9 are separated from a sheet pile or stack 7 of the feeder 2 by a separating unit 11, and conveyed to the sheet-fed rotary printing machine 1 via a feed table 12. A swivellably or pivotally arranged pregripper 13 is provided at an end of the feed table 12 which is directed towards the printing machine, and the pregripper 13 grips the sheets 9 at the end of the feed table 12 and transfers them to gripper devices 15 of a feed drum 14 of the sheet-fed rotary printing machine 1.

Figure 2:
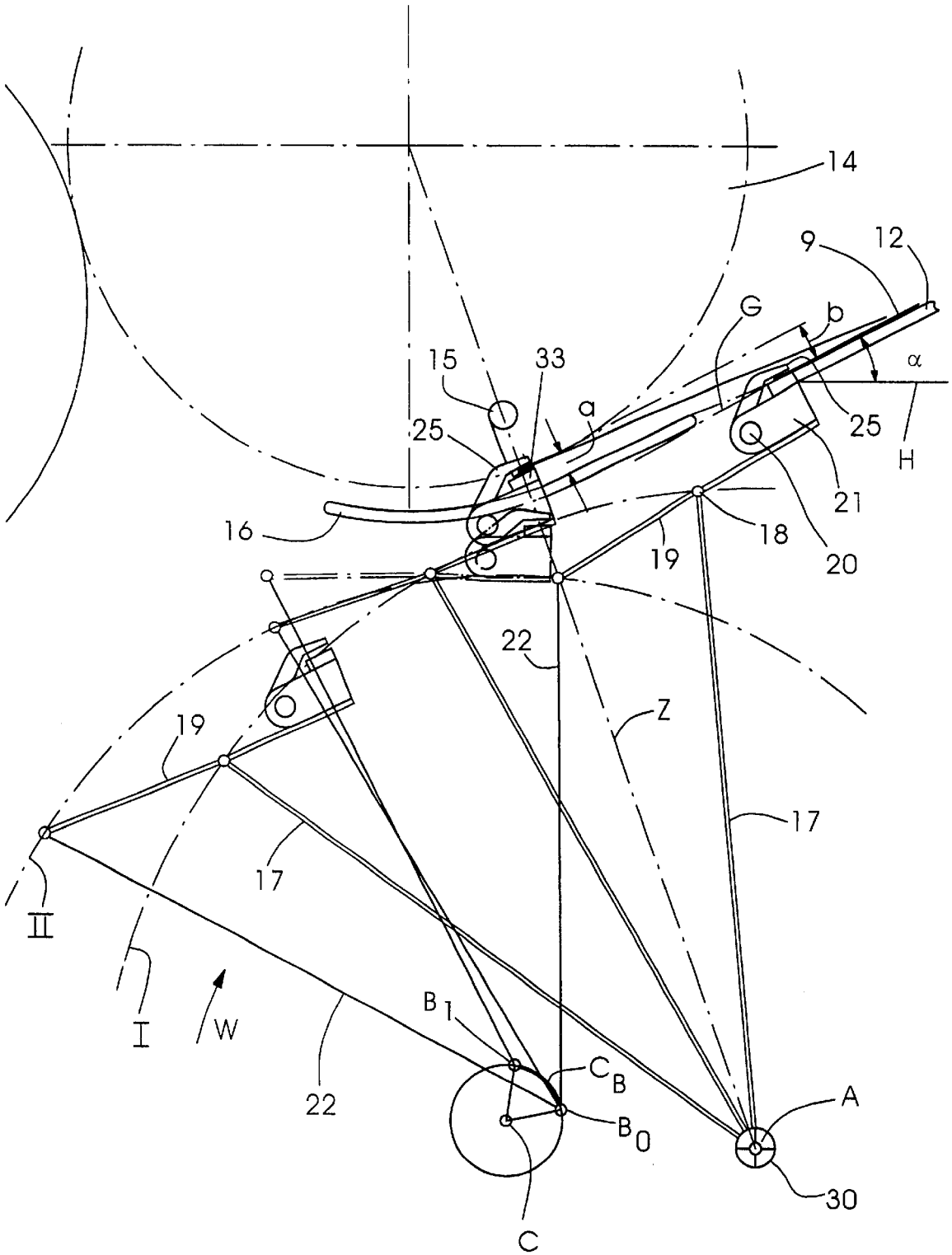
FIG. 2 is a diagrammatic view of the pregripper movement according to the invention.

Stationary directing tongues 16 are distributed, at a spaced distance apart from one another, over the axial length of the feed drum 14 and, according to FIG. 2, spaced a distance a away from the feed drum 14.

The feed table 12 is inclined at an angle $\alpha=10° \ldots 25°$ with respect to a horizontal H. An imaginary extension G of the feed table 12 is spaced a distance b from the periphery of the feed drum 14.

According to FIG. 3, the pregripper 13 has a main lever 17 that is mounted so that it can be swivelled or pivoted about a framework-fixed swivel or pivot point A located beneath the feed plane. At the end of the main lever 17 directed away from the pivot or swivel point A, the main lever 17 bears a two-armed couple 19 at an articulated location 18. A gripper bar 21 is arranged at one end of the first arm of the couple 19. The gripper bar 21 bears a number of pregripper grippers 25, which are opened and closed by a common gripper shaft 20. In order to economize on moved masses, the gripper shaft 20 may be the articulated location 18.

Articulated at one end of the second arm of the couple 19 is a guide lever 22 that is mounted so that it can be pivoted or swivelled reciprocatingly about a swivel or pivot point B. The swivel or pivot point B, in turn, is mounted so that it can be changed eccentrically about a framework-fixed pivot or swivel point C. Due to the measure of superposing the pivoting or swivelling movements of the guide lever 22 about the swivel or pivot point B, and of the swivel or pivot point B about the swivel or pivot point C, it is possible, as illustrated in FIG. 2, for the gripper bar 21 and the couple 19 to be guided on different movement paths I and II. The main drive of the pregripper 13 is effected by the pivoting or swivelling of the main lever 17 about the framework-fixed bearing location A at 30.

Due to the superposing of the pivoting or swivelling movement of the guide lever 22 and the additional eccentric pivoting or swivelling movement of the pivot or swivel point B about the framework-fixed pivot or swivel point C in accordance with the invention, two different movement paths I and II are achieved for the reciprocating pivoting or swivelling movement. During the feed movement, the sheet 9 is lifted slightly by the gripper bar 21, so that the feed movement takes place above the stationary directing tongues 16 and above the imaginary extension G of the feed table 12, while the return pivoting or swivelling movement proceeds beneath the stationary directing tongues 16 and beneath the imaginary extension G of the feed table 12.

When the sheet 9 is received or taken over from the feed table 12, according to FIG. 2, the pivot or swivel point B of the guide lever 22 is located in a first end position, namely a "zero position $B_o$". After the sheet 9 has been received by the pregripper 13, the guide lever 22 pivots or swivels about one or various points B of the couple or coupling-link curve $C_B$ in the direction of the feed drum 14, which, initiated by the pivoting or swivelling movement of the main lever 17 about the point A, is achieved by the main drive 35, 39, 40 and the couple 19. After the sheet 9 has been transferred to the gripper device 15 of the feed drum 14, the further pivoting or swivelling movement of the guide lever 22 takes place about one or more points B of the couple curve $C_B$ up to a turning position W of the guide lever 22.

At the turning position W, or as the pregripper 13 starts a return pivoting or swivelling movement about the point A, the guide lever 22 is pivoted or swivelled over a given angle, e.g., approximately 90°, by a control cam 26 driven in time with the printing-machine cycle, into different positions of the point B about the framework-fixed pivot point C, so that the pivoting or swivelling movement of the lever 22 from the turning position W back to the feed table 12 takes place about the points B of the couple curve $C_B$. Only a few angular degrees before arrival at the feeding table 12, the pivot or swivel point B is pivoted or swivelled back into the zero position $B_o$, in order to lift the gripper bar 21 and thus the pregripper grippers 25 to the level of the feed table 12.

In the exemplary embodiment, the pivoting or swivelling movement of the guide lever 22 about the point B takes place indirectly, via the couple 19 and the main lever 17, about the pivot or swivel point A of which a cyclically pivotably or swivellably driven pregripper main shaft 30 is arranged.

The pregripper main shaft 30 is driven by the lever 35, the cam roller 39 and the cam 40 cyclically driven in time with the machine, as shown in FIG. 2.

The pivoting or swivelling movement of the pivot or swivel point B about the framework-fixed bearing point C is effected by a roller lever 23 that bears a rotatably mounted cam roller 24 which rolls on the cam 26 driven cyclically in time with the printing machine.

An added feature of the invention is shown in FIG. 4 wherein the roller lever 23 of the embodiment of FIG. 3 is replaced by two individual levers 27 and 28.

The levers 27 and 28 are respectively arranged with a lower end pivotable or swivellable about the pivot or swivel point C. A second end of the lever 28 is articulatingly connected to an actuator 29 and the cam roller 24. A second end of the lever 27 is articulatingly connected to the end of the guide lever 22 and the actuator 29. A restoring spring 31 arranged between the cam roller 24 and the guide roller 22 eliminates any possible play that might occur in the region of the actuator 29. The actuator 29 may be constructed, for example, as an electromotorized actuating drive or a pneumatic or hydraulic cylinder.

A sensor 32 senses or determines, on the sheet-path level defined by a center line Z intersecting the pivot or swivel point A of the main lever 17, the center of the gripper bearing 33 (note FIG. 2) and the axis 34 of the feed cylinder 14, a spaced distance c between a reference point 41 (note FIG. 6) and the center line Z. The reference point may be defined, for example, by the sensor 32. The sensor 32 may thereby be fastened on the feed cylinder 14. It is likewise possible for the sensor to be fastened on the pregripper 13 and to sense or determine the distance c in relation to a reference surface on a measuring lug 41 on the feed drum 14. If the determined distance c deviates from a predetermined nominal or desired value, the actuator 29 receives a corresponding actuating signal from a signalling device 42, with the result that any distance deviating from the distance c is corrected.

In a further embodiment of the invention shown in FIG. 5, provision is made for the actuator 29 to be arranged between a framework-fixed bearing location 36 and a stop 37 that is located on the roller lever 23. In the case of a correction, the actuator 29, through the intermediary of the stop 37 on the roller lever 23, lifts the cam roller 24 off the cam 26 by the required amount of correction. A restoring spring 38 arranged framework-fixed on the stop 37 draws the stop 37 against the actuator 29, and the cam roller 24 against the cam 26, respectively.

In an added exemplary embodiment according to FIG. 6, the sensor is fastened to the pregripper and determines the distance c in relation to a reference surface on a measuring lug 41 on the feed drum 14.

In an additional exemplary embodiment according to FIG. 7, the sensor 32 is fixedly arranged on the feed table 12. In this regard, the sensor 32 determines or senses a spaced distance e between the pregripper bar 21 and the feed table 12. Deviations from a predetermined nominal or desired value are corrected as described hereinabove.

We claim:

1. A device for driving a pregripper, comprising:

a swivellably mounted main lever having a framework-fixed mounting point;

a framework-fixed bearing point;

a guide lever having a bearing location, said guide lever swivellably mounted about said fixed bearing point at said bearing location;

a gripper bar mutually coupling said main lever and said guide lever; and a cyclical swivel drive for driving said main lever.

2. The driving device according to claim 1, including a feed table, and an imaginary extension of said feed table spaced a given distance from a periphery of a feed drum.

3. The driving device according to claim 2, wherein, during a transporting movement of a sheet from said feed table to gripper devices of said feed drum, a movement path is describable by the pregripper differing from that of a return movement thereof back to said feed table from a turning position of the pregripper.

4. The driving device according to claim 3, wherein, during the transporting movement of the sheet from said feed table to said gripper devices of said feed drum, the sheet is movable by the pregripper into an infeed gap defined by an imaginary extension of said feed table and a periphery of said feed drum, the pregripper, during said return movement thereof, being movable back beneath said imaginary extension of said feed table.

5. The driving device according to claim 1, wherein the pregripper has a first cam gear mechanism for swivellingly moving the main lever, and a second cam gear mechanism for swivellingly moving the gripper bar.

6. The driving device according to claim 5, wherein said first cam gear mechanism is connected to a couple by the main lever, and said second cam gear mechanism is connected to said couple by the guide lever.

7. The driving device according to claim 6, wherein an articulated point of the main lever on said couple is a gripper shaft of a gripper of the pregripper.

8. The driving device according to claim 1, including fixedly disposed directing brackets.

9. The driving device according to claim 8, wherein said directing brackets are spaced apart a given distance from said feed drum of said feed table.

10. The driving device according to claim 9, wherein said given distance between said directing brackets and said feed drum is at most equal to a distance between an imaginary extension of said feed table and said feed drum.

11. The driving device according to claim 1, including a sensor and an actuator for correcting incorrect movements of the pregripper.

12. The driving device according to claim 11, wherein said sensor is disposed on a feed drum.

13. The driving device according to claim 11, wherein said sensor is disposed on a structural feature selected from the group consisting of a feed drum, a feed table and the pregripper.

14. The driving device according to claim 11, wherein said sensor is disposed in a stationary manner.

15. The driving device according to claim 1, including a roller lever having a cam roller, said roller lever connected to said guide lever for deflecting said guide lever and for changing a distance between said cam roller and said bearing location.

16. The driving device according to claim 15, wherein said roller lever is formed of two swivellable levers having a common swivel point.

17. The driving device according to claim 16, wherein said swivellable levers are mutually coupled by an actuator.

18. The driving device according to claim 17, wherein one of said swivellable levers is articulated on the guide lever, and the other of said swivellable levers bears said cam roller.

19. The driving device according to claim 15, including an actuator disposed between a framework-fixed bearing point and a stop of said roller lever.

20. The driving device according to claim 14, wherein said actuator is capable of receiving correction signals as a function of incorrect movements of the pregripper which have been determined by a sensor.

21. The driving device according to claim 1, including a sensor for determining incorrect movements of the pregripper, and an actuator connected to said sensor for receiving correction signals from said sensor.

22. The driving device according to claim 1, including an eccentric for eccentrically driving said guide lever.

* * * * *